US006327826B1

(12) United States Patent
Mann

(10) Patent No.: US 6,327,826 B1
(45) Date of Patent: Dec. 11, 2001

(54) STRUCTURAL FRAME MEMBER

(75) Inventor: Robert McGowan Mann, Devon (GB)

(73) Assignee: Lorient Polyproducts Limited (GB)

( * ) Notice: Subject to any disclaimer, the term of this patent is extended or adjusted under 35 U.S.C. 154(b) by 0 days.

(21) Appl. No.: 09/117,692

(22) PCT Filed: Jan. 31, 1997

(86) PCT No.: PCT/GB97/00271

§ 371 Date: Apr. 26, 1999

§ 102(e) Date: Apr. 26, 1999

(87) PCT Pub. No.: WO97/28344

PCT Pub. Date: Aug. 7, 1997

(30) Foreign Application Priority Data

Feb. 1, 1996 (GB) ..... 9601998

(51) Int. Cl.[7] ..... E06B 1/04; E06B 1/26; E06B 1/32

(52) U.S. Cl. ..... 52/204.1; 52/204.5; 52/232; 52/1

(58) Field of Search ..... 52/232, 205, 204.1, 52/204.5

(56) References Cited

U.S. PATENT DOCUMENTS

| | | | | |
|---|---|---|---|---|
| 4,189,520 | * | 2/1980 | Gauchel | 428/520 |
| 4,603,524 | * | 8/1986 | Mann | 52/232 |
| 5,355,654 | * | 10/1994 | Stanley | 52/784.1 |
| 5,651,223 | * | 7/1997 | Novak et al. | 52/211 |
| 5,687,532 | * | 11/1997 | Torrey | 52/656.3 |
| 5,740,635 | * | 4/1998 | Gil | 52/79.1 |
| 5,884,683 | * | 3/1999 | Sears | 160/90 |
| 5,983,570 | * | 11/1999 | Brown | 49/475.1 |

* cited by examiner

*Primary Examiner*—Laura A. Callo
(74) *Attorney, Agent, or Firm*—Paul F. Wille

(57) ABSTRACT

A frame assembly includes a non-combustible rigid filler sheet supported within a surrounding support frame made from lengths of a structural frame member joined together. The structural frame member has an elongate body extruded from a heat meltable material and has longitudinally extending cavities. Intumescent material is located in selected cavities.

15 Claims, 4 Drawing Sheets

STRUCTURAL FRAME MEMBER

The present invention relates to a structural frame member used in particular but not exclusively in the construction of window frames, door frames and door leaves.

In the United Kingdom, a British Standard exists, BS 476 Part 20 and Part 22, which stipulates the necessary requirements for achieving a fire rating and a 30 minute fire rating is a common fire rating required for windows or door assemblies to be used in public buildings.

Structural frame members are known which are extruded from heat meltable materials, such as plastics, in particular polyvinylchloride or metals such as aluminium.

Since these materials melt with heat, they normally exhibit poor fire rating characteristics when exposed to fire conditions, say in a building. For example a window assembly including a frame constructed from members of polyvinylchloride normally may only have a fire rating of less than 10 minutes.

It is a general aim of the present invention to provide a structural frame member formed from a heat meltable material and which enables a window or door assembly to be constructed therefrom and achieve a much longer fire rating than heretofore.

Another general aim of the present invention is to provide a method of enhancing the performance of an otherwise heat meltable material in the form of a structural member so as to achieve a recognizable fire rating of at least 30 minutes under the conditions of relevant international fire test standards.

According to one aspect of the present invention there is provided a structural frame member including an elongate body extruded from a heat meltable material, the body including longitudinally extending cavities and intumescent material located in selected cavities.

According to another aspect of the present invention there is provided a frame assembly comprising a non combustible rigid filler sheet supported within a surrounding support frame, the support frame comprising lengths of the structural frame member as defined above jointed together.

Preferably the intumescent material is located in primary cavities positioned directly inbetween the edge of the filler sheet and the surrounding supporting structure to which the support frame is secured, the amount of intumescent material within the primary cavities being such that on intumescence, the foamed intumescent material acts to provide a compressive force on the filler sheet for providing structural support for the filler sheet after softening/melting of the heat meltable material.

In addition to or as an alternative to locating intumescent material within said primary cavities, intumescent material is located within secondary cavities located to one side of the primary cavities, the amount of intumescent material in each of said secondary cavities being such that after intumescing the intumesced material substantially fills each cavity and thereby provides a heat insulative barrier.

Preferably the intumescent material located in each cavity is in strip form and is preferably encapsulated in an extruded sheath, as an assembly aid, formed from a compatible plastics material, preferably polyvinylchloride. Alternatively, an intumescent paste or mastic may be injected into each cavity.

Preferably the intumescent material is a hydrated sodium silicate. Preferably the lengths of the structural frame member are jointed together by welding the lengths together. The heat meltable material such as polyvinylchloride is preferably thermally welded, but chemical welding is also envisaged.

In the case of a window assembly, the filler sheet may be any suitable pane of glass but is preferably wire reinforced or chemically or physically modified in order to provide sufficient fire resistance commensurate with the frame. The filler sheet may comprise single or multiple panes of glass.

In the case of a door assembly, the filler sheet may comprise one or more panes of glass and/or may comprise any suitable non-combustible sheet material suitable for door constructions, eg. gypsum, calcium silicate or vermiculite based board.

The heat meltable material is chosen so as to be sufficiently rigid to provide structural support under normal operating conditions, e.g. at temperatures less than 50° C.

According to another aspect of the present invention there is provided a method of producing a structural frame member including extruding a frame body from a heat meltable material so as to include longitudinally extending cavities, and subsequently inserting intumescent material into selected cavities. Preferably the intumescent material is in strip form and is longitudinally inserted into said selected cavities.

Various aspects of the present invention are hereinafter described with reference to the accompanying drawings in which.

Figure 1:
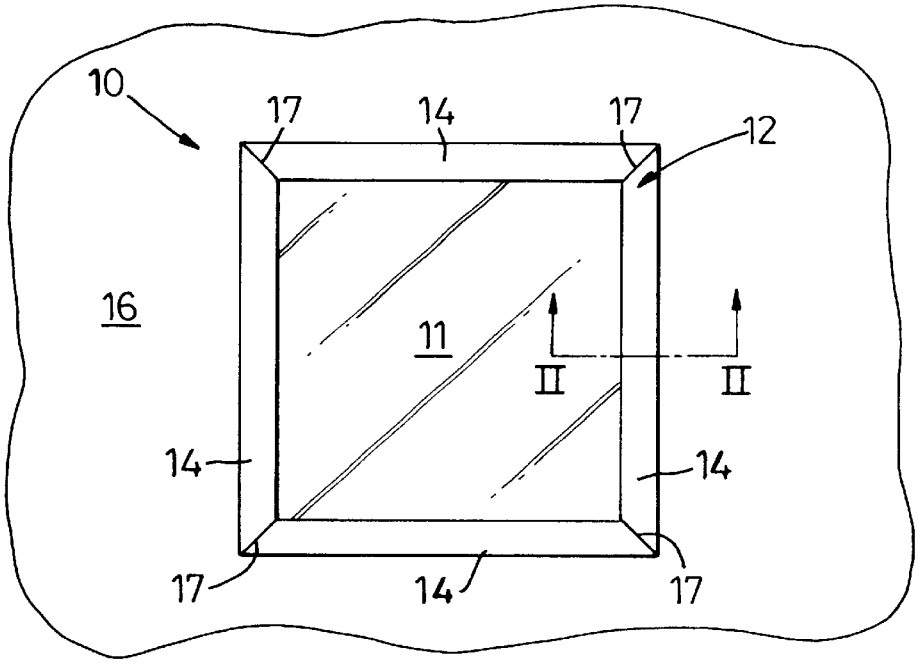
FIG. 1 is a schematic side view of a window assembly according to the present invention.

Referring initially to FIG. 1, there is shown a window assembly 10 including a window pane 11 supported in a support frame 12. The support frame 12 extends along each side edge of the pane 11 and is secured in an opening formed in a surrounding support structure 16 such as a building wall.

The support frame 12 includes four lengths of a structural frame member 14 which are jointed to another preferably by mitre joints 17 as illustrated.

Figure 2:
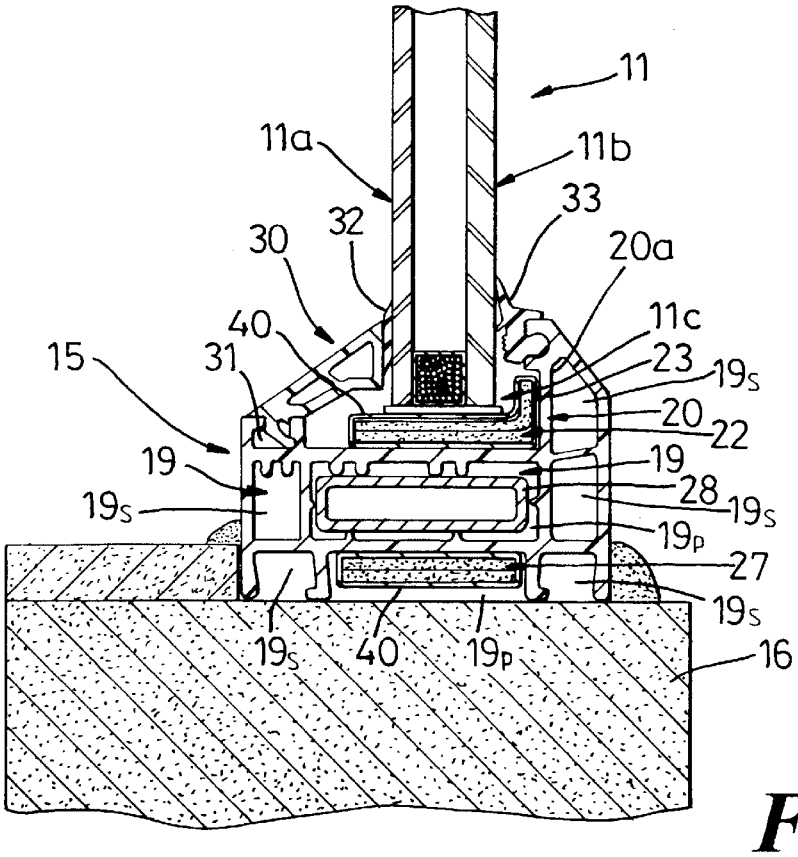
FIG. 2 is a sectional view taken along line II—II in FIG. 1.

As best seen in FIG. 2, the structural frame member 14 comprises a main elongate body 15 which is extruded from a heat meltable material such as a plastics material, preferably polyvinylchloride.

The body 15 includes a plurality of cavities 19 defined by internal partition walls. The majority of the cavities 19 are totally enclosed in cross-section, but those located at the surface of the body 15 are open-sided in cross-section.

The body 15 defines a rebate portion 20 for receiving the window pane 11. A strip 22 of intumescent material is located between the edge of the window pane 11 and the rebate portion 20 to define a seat for the window pane 11. In between the rebate portion 20 and the support structure 16 are a pair of primary cavities 19*p*. One cavity 19*p* contains a strip 27 of intumescent material and the other cavity 19*p* is filled with non-combustible rigid reinforcing member 28. The reinforcing member 28 may be omitted and if so, the cavity would contain a strip 27 of intumescent material. The reinforcing member 28 is preferably provided to give rigidity to the body 15.

The window pane 11 is held in the rebate portion 20 by a separate elongate body member 30 which is lockingly engaged into a groove 31 formed in the main body 15. Body member 30 is preferably extruded from the same material as the body 15.

Seals 32, 33, for example of silicone rubber, are provided to create a seal between the bodies 15, 30 and the window pane 11. In the embodiment illustrated in FIG. 2 the window pane 11 is a double glazed unit including two side by side panes of glass 11*a*, 11*b* which are sealed together by sealing element 11*c*.

In use, the window frame 12 is mounted in the structure 16 such that vertical wall 20*a* of the rebate portion 20 faces toward the expected 30 source of fire, i.e. in a building, it faces toward the interior of the building.

In the event of a fire, the material of the frame bodies 15, 30 facing the interior of the building initially soften, then melt and then char.

Figure 3:
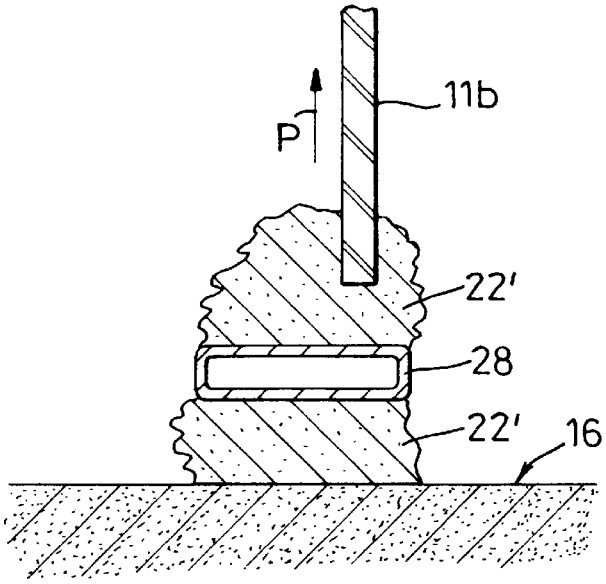
FIG. 3 is a schematic view similar to FIG. 2 after exposure to fire.

The intumescent material within cavities 19*p* and strip 22 are chosen to begin intumescing when the material of the frame begins to soften. This enables the intumescent material in the primary cavities to expand and seal gaps created by the frame body material as it softens/melts. In addition the amount of intumescent material in the primary cavities is chosen such that after intumescing it occupies a far greater volume than the volume of the primary cavities 19*p*. In this way the intumescent material as it intumesces applies a compressive pressure (indicated by arrow P) inwards of the pane 11 and thereby serve to structurally support the pane 11 after collapse of the body 15. This is illustrated schematically in FIG. 3.

The intumescent strip 22 preferably includes an upwardly directed flange portion 23 which overlies the outer marginable portion of the pane 11. The flange is provided in order to help prevent the pane 11 being pushed sideways toward the non-exposed side of the window when the intumescent material located closer to the exposed side begins to intumesce.

The intumescent material is preferably chosen such that its degree of expansion or intumesce is greater in a direction perpendicular to the plane of the strip compared to the direction parallel to the plane. Accordingly, the flange portion 23 is preferably formed such that its direction of maximum expansion is perpendicular to the plane of the pane 11. Preferably, the reinforcing member 28 is a non-combustible metal such as steel.

The cavities 19*s* located to the side of the primary cavities 19*p* may also contain strips of intumescent material.

The amount of intumescent material located in cavities 19*s* is preferably chosen such that after intumescing, the intumesced material completely fills the cavity without causing significant distortion of the body 15. The main purpose of the intumescent material in the secondary cavities is to provide an insulation barrier to transmission of heat. Such an insulation barrier helps to reduce the likelihood of distortion of the reinforcing member 28 due to heat.

Preferably, the intumescent material is enclosed in a sheath 40, preferably formed from a heat fusible material such as polyvinylchloride having a softening point lower in temperature than the activation temperature of the intumescent material.

Preferably the intumescent material is a hydrated sodium silicate. This material is preferred since it intumesces at a temperature between 100–150° C. (the softening temperature of polyvinylchloride being in the range of 80–100° C.) and exhibits good rigidity/mechanical strength characteristics when intumesced. It also exhibits good insulative characteristics. It will be appreciated that intumescent materials exhibiting similar characteristics could be used.

Preferably the intumescent strips are located into the cavities of body 15 by insertion in the longitudinal direction.

Figure 4:
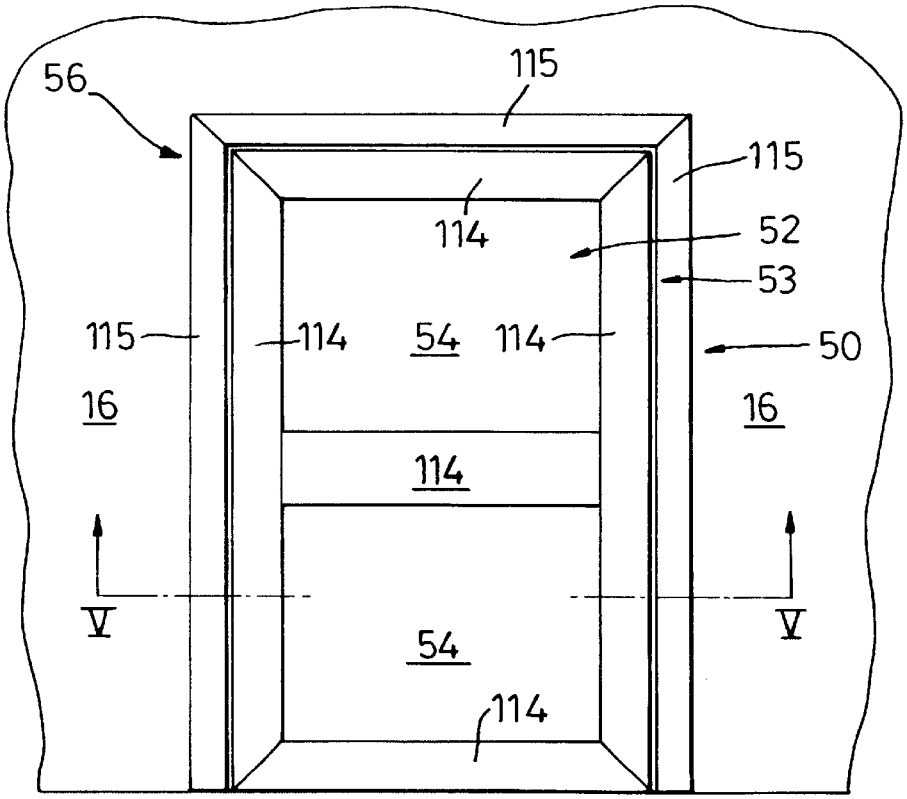
FIG. 4 is a schematic side view of a door and frame assembly according to the present invention.
Figure 5:
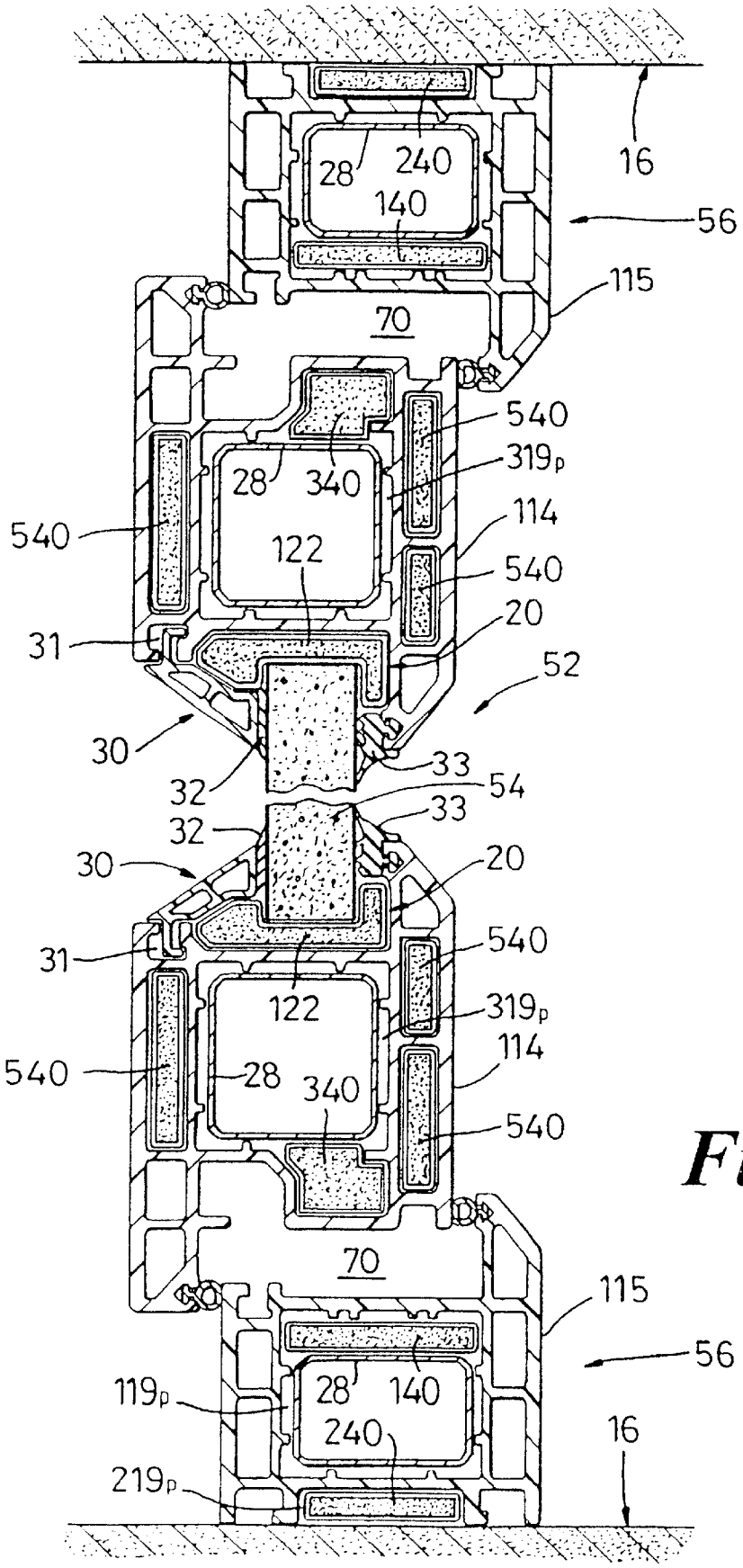
FIG. 5 is a sectional view taken along line V—V in FIG. 4.
Figure 6:
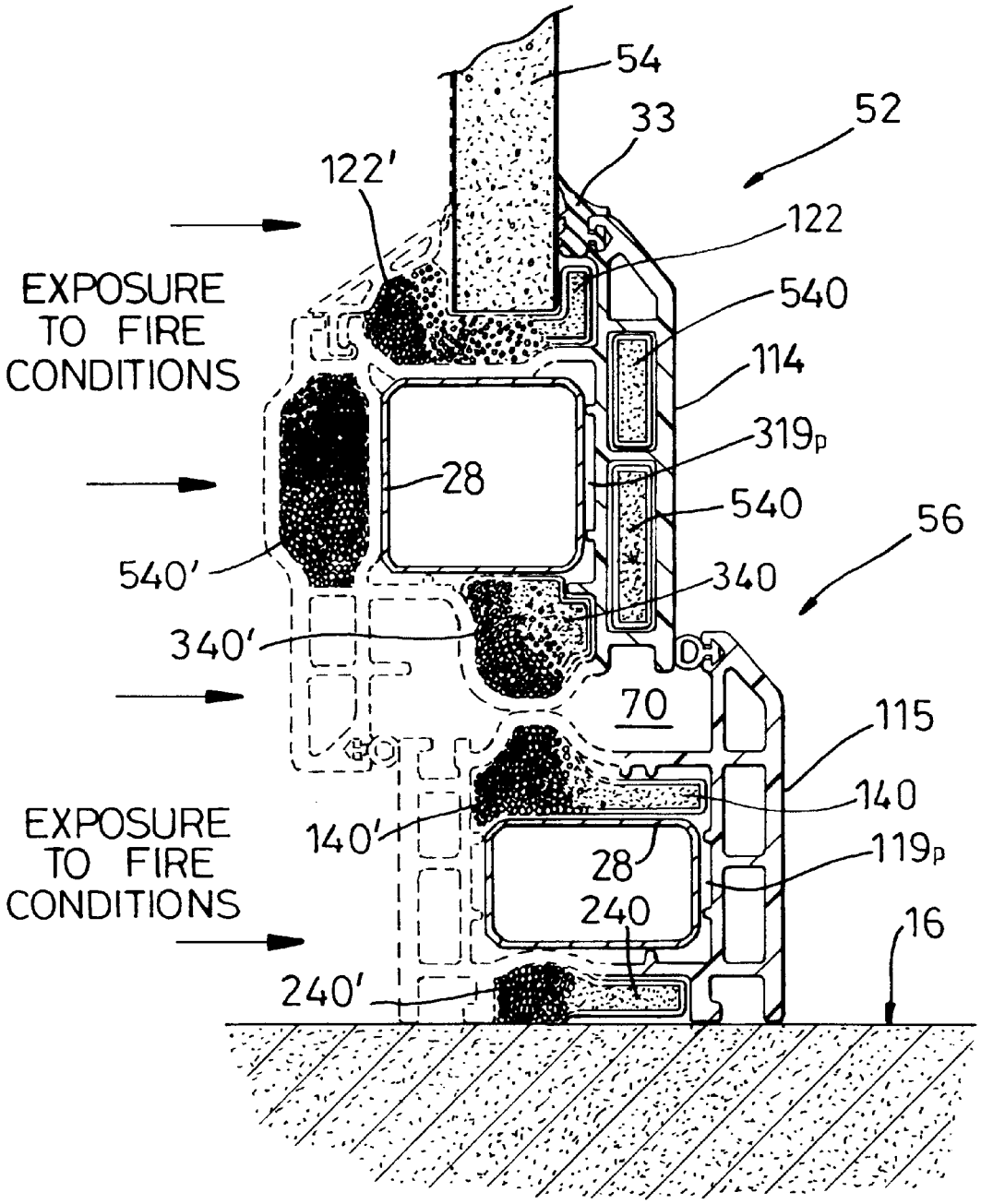
FIG. 6 is a part sectional view similar to FIG. 5 after exposure to fire.

A door and frame assembly 50 according to the present invention is shown in FIGS. 4 to 6.

The assembly 50 includes structural frame members 114, 115 similar to structural frame members 14 described above.

A first set of frame members 114 are joined together to define a door 52 comprising a rectangular support frame 53 housing a filler sheet 54. A second set of structural frame members 115 are joined together to define a door frame 56 surrounding the door 52. Door 52 is hingedly connected to frame 56 in a conventional manner and the frame 56 is fixed to a support structure 16 in a conventional manner.

The structural frame members 115 include a first primary cavity 119*p* and a second primary cavity 219*p*. The first cavity 119*p* includes a reinforcing member 28 and a strip of intumescent material 140 located on the inner side (ie. nearest to the door opening) of the reinforcing member 28. A strip of intumescent material 240 is located within cavity 219*p*.

The structural members 114 preferably include a central primary cavity 319*p* housing a reinforcing member 28 and a strip of intumescent material 340 located on the outer side (ie. nearest to the outer side of the door) of the reinforcing member 28.

The structural members 114 also preferably include a rebate portion 20 similar to that of members 14 for receiving the filler sheet 54. A strip of intumescent material 122 is located between the edge of the filler sheet and the rebate portion 20 to define a seat for the filler sheet 54. The sheet 54 is held in the rebate portion 20 by a separate elongate body member 30 and is lockingly engaged in groove 31 of the main body in a similar manner to that described in relation to the window frame above.

The structural members 114 include secondary cavities on the front and rear sides of the reinforcing member 28 and are preferably filled with intumescent material 540 in order to provide a heat insulation barrier for heat shielding the reinforcing member 28 in the event of a fire.

As seen in FIG. 6, under fire conditions, the intumescent material 140, 340 expands to fill the gap 70 with intumesced material 140' and 340' between the door 52 and door frame 56.

The intumescent material 240 and 122 also expand to form intumesced masses 240' and 122' and co-operate with the reinforcing members 28 within structural members 114, 115 to provide mechanical support for the filler sheet 54.

In the illustration of FIG. 6, the parts of the structural members 114, 115 which are destroyed by melting are indicated in broken lines. Also intumescent material 540 located on the fire exposed side of the reinforcing member 28 is shown as being expanded to define an intumesced mass 540' which forms a heat insulation baffler for shielding the reinforcing member 28.

What is claimed is:

1. A frame assembly comprising a non-combustible rigid filler sheet supported within a surrounding support frame, the support frame comprising a plurality of structural frame members joined together, each structural frame member including an elongate body extruded from a heat meltable material which melts or softens under fire conditions, the body including a plurality of longitudinally extending cavities and intumescent material located in selected cavities, wherein the intumescent material is encapsulated in an extruded sheath, the intumescent material under fire conditions forming a foamed intumesced material which acts to provide structural support for the filler sheet after softening or melting of the heat meltable material.

2. An assembly according to claim 1 wherein the lengths of the structural frame member are jointed together by welding.

3. An assembly according to claim 1 adapted for use as a window frame assembly and wherein the filler sheet comprises one or more panes of glass.

4. An assembly according to claim 1 adapted for use as a door assembly and wherein the filler sheet comprises one or more panes of glass and/or sheets of suitable non-combustible boards.

5. A structural frame member for use in the construction of a support frame in a surround, the structural frame member including an elongate body extruded from a heat meltable plastics material, the body having an outer side which in use faces the surround and an inner side located opposite to said outer side and a plurality of longitudinally extending cavities located between said inner and outer sides of said body, a non-combustible rigid reinforcing member housed within one of said cavities and intumescent material located between said reinforcing member and said inner and/or outer side.

6. A method of producing a structural frame member for use in a surround including extruding a frame body, said frame body having an outer side adapted to face the surround and an inner side located opposite to said outer side, from a heat meltable plastics material so as to include longitudinally extending cavities located between said inner and outer sides of the body, and subsequently inserting a non-combustible reinforcing member into one of said cavities and inserting intumescent material so as to be located between said reinforcing member and said inner and/or outer side.

7. A method according to claim 6 wherein the intumescent material is in strip form and is longitudinally inserted into said cavities.

8. A frame assembly comprising a non-combustible rigid filler sheet supported within a surrounding support frame, the support frame comprising a plurality of structural frame members joined together, the structural frame member including an elongate body extruded from a heat meltable material which melts or softens under fire conditions, the body including a plurality of longitudinally extending cavities and intumescent material located in selected cavities, the intumescent material under fire conditions forming a foamed intumesced material which acts to provide structural support for the filler sheet after softening or melting of the heat meltable material, wherein the intumescent material is located in primary cavities positioned directly inbetween the edge of the filler sheet and a surrounding supporting structure to which the support frame is secured in use, the amount of intumescent material within the primary cavities being such that, on intumescence, the foamed intumescent material acts to provide a compressive force on the filler sheet for providing structural support for the filler sheet after softening/melting of the heat meltable material, wherein a non-combustible rigid reinforcing member is located in one of said primary cavities.

9. A frame assembly according to claim 8 wherein the intumescent material is encapsulated in an extruded sheath.

10. A frame assembly according to claim 8 wherein the intumescent material is in paste or mastic form.

11. An assembly according to claim 8 wherein the intumescent material is located in primary cavities positioned directly inbetween the edge of the filler sheet and a surrounding supporting structure to which the support frame is secured in use, the amount of intumescent material within the primary cavities being such that on intumescence, the foamed intumescent material acts to provide a compressive force on the filler sheet for providing structural support for the filler sheet after softening/melting of the heat meltable material.

12. An assembly according to claim 11 wherein intumescent material is located within secondary cavities located to one side of the primary cavities, the amount of intumescent material in each of said secondary cavities being such that after intumescing the intumesced material substantially fills each cavity and thereby provides a heat insulative barrier.

13. An assembly according to claim 11 wherein the intumescent material is encapsulated in an extruded sheath.

14. An assembly according to claim 11 wherein the intumescent material is in paste or mastic form.

15. A frame assembly comprising:

a non-combustible rigid filler sheet supported within a surrounding support frame, the support frame comprising a plurality of structural frame members joined together, each structural frame member including an elongate body extruded from a heat meltable material which melts or softens under fire conditions, the body including a plurality of longitudinally extending cavities and intumescent material located in selected cavities, wherein the intumescent material is encapsulated in an extruded sheath, wherein the intumescent material is located in primary cavities positioned directly inbetween the edge of the filler sheet and a surrounding supporting structure to which the support frame is secured in use, the intumescent material under fire conditions forming a foamed intumesced material which acts to provide structural support for the filler sheet after softening or melting of the heat meltable material, the amount of intumescent material within the primary cavities being such that on intumescence, the foamed intumescent material acts to provide a compressive force on the filler sheet for providing structural support for the filler sheet after softening/melting of the heat meltable material.

* * * * *